US008413476B2

(12) United States Patent
Seilinger et al.

(10) Patent No.: US 8,413,476 B2
(45) Date of Patent: Apr. 9, 2013

(54) ROLLING MILL STAND FOR THE PRODUCTION OF ROLLED STRIP OR SHEET METAL

(75) Inventors: Alois Seilinger, Linz (AT); Markus Widder, Linz (AT)

(73) Assignee: Siemens Vai Metals Technologies GmbH (AT)

( * ) Notice: Subject to any disclaimer, the term of this patent is extended or adjusted under 35 U.S.C. 154(b) by 0 days.

(21) Appl. No.: 12/304,937

(22) PCT Filed: Jun. 13, 2007

(86) PCT No.: PCT/EP2007/005218

§ 371 (c)(1),
(2), (4) Date: Oct. 22, 2009

(87) PCT Pub. No.: WO2007/144162

PCT Pub. Date: Dec. 21, 2007

(65) Prior Publication Data

US 2010/0031724 A1 Feb. 11, 2010

(30) Foreign Application Priority Data

Jun. 14, 2006 (AT) ..... A 1021/2006

(51) Int. Cl.
*B21B 31/18* (2006.01)

(52) U.S. Cl. ..... 72/247; 72/241.2; 72/242.4

(58) Field of Classification Search ..... 72/241.2, 72/242, 2, 242.4, 243.6, 247, 252.5
See application file for complete search history.

(56) References Cited

U.S. PATENT DOCUMENTS 3,857,268 A * 12/1974 Kajiwaka ..... 72/247
4,519,233 A * 5/1985 Feldmann et al. ..... 72/241.4
(Continued)

FOREIGN PATENT DOCUMENTS

AT 410765 B 7/2003
CA 2018261 C 11/1994
(Continued)

OTHER PUBLICATIONS

Decision on Grant dated Sep. 21, 2011 issued in corresponding Russian Application No. 2009100918 with English translation (8 pages).

(Continued)

*Primary Examiner* — Edward Tolan
(74) *Attorney, Agent, or Firm* — Ostrolenk Faber LLP

(57) ABSTRACT

A rolling mill stand for production of rolled strip or sheet metal has working rolls which are supported on supporting rolls or on intermediate rolls and supporting rolls. The working rolls and/or intermediate rolls are arranged in the rolling mill stand so as to be displaceable axially with respect to one another. Each working and/or intermediate roll has a curved barrel contour which runs over the entire effective barrel length and can be described by a trigonometric function. The two barrel contours of adjacent rolls complete one another in a complementary way, in the unloaded state, solely in one specific relative axial position of the rolls of the pair of rolls, so that inhomogeneities in the load distribution along the contact line of two adjacent rolls are to be minimized. For this purpose, the supporting rolls have a complementary barrel contour, and a partial or full completion of the barrel contours of the supporting rolls and of the directly adjacent working rolls or intermediate rolls occurs in the unloaded state.

8 Claims, 7 Drawing Sheets

U.S. PATENT DOCUMENTS

| | | | | |
|---|---|---|---|---|
| 4,781,051 | A | 11/1988 | Schultes et al. | |
| 4,800,742 | A | 1/1989 | Feldmann et al. | 72/247 |
| 4,881,396 | A * | 11/1989 | Seidel et al. | 72/247 |
| 4,955,221 | A | 9/1990 | Feldmann et al. | |
| 5,622,073 | A * | 4/1997 | Hiruta et al. | 72/247 |
| 6,119,500 | A * | 9/2000 | Ginzburg et al. | 72/247 |
| 6,868,707 | B2 | 3/2005 | Nishi et al. | |
| 7,123,703 | B2 | 10/2006 | Hausmann et al. | 379/114.2 |
| 7,181,949 | B2 * | 2/2007 | Haberkamm et al. | 72/243.6 |
| 7,367,209 | B2 | 5/2008 | Ritter et al. | 72/247 |
| 2003/0164020 | A1 | 9/2003 | Haberkamm et al. | 72/241.2 |
| 2005/0034501 | A1 | 2/2005 | Seilinger et al. | |
| 2005/0044916 | A1 | 3/2005 | Honjo et al. | 72/243.6 |

FOREIGN PATENT DOCUMENTS

| | | | |
|---|---|---|---|
| CN | 1555297 | A | 12/2004 |
| DE | 101 02 821 | | 7/2002 |
| EP | 0 091 540 | A1 | 10/1983 |
| EP | 0 249 801 | A1 | 12/1987 |
| EP | 0 258 482 | A1 | 3/1988 |
| EP | 0 401 685 | B2 | 3/2000 |
| EP | 1 228 818 | A2 | 8/2002 |
| EP | 1 249 801 | | 10/2002 |
| EP | 1 228 818 | | 11/2008 |
| JP | 55-103201 | | 8/1980 |
| JP | 56030014 | A | 3/1981 |
| JP | 58-187207 | | 11/1983 |
| JP | 59-56905 | | 4/1984 |
| JP | 03013218 | A | 1/1991 |
| JP | 2001252705 | A | 9/2001 |
| RU | 1355112 | A3 | 4/1983 |
| RU | 1816235 | A3 | 6/1987 |
| RU | 2 115 493 | | 7/1998 |
| RU | SU 1306468 | | 12/2004 |
| RU | 2003125863 | | 1/2005 |
| RU | 2004110929 | | 6/2005 |
| RU | 2 268 795 | | 1/2006 |
| RU | 2 280 518 | | 7/2006 |
| WO | WO 02/09896 | | 2/2002 |
| WO | WO 02/11916 | | 2/2002 |
| WO | WO 03/022470 | | 3/2003 |
| WO | WO 2005/058517 | | 6/2005 |
| WO | WO 2007/014161 | | 2/2007 |
| WO | WO 2007/144161 | | 12/2007 |
| WO | WO 2007/144162 | | 12/2007 |

OTHER PUBLICATIONS

Opposition dated Aug. 25, 2011 issued in corresponding European Application No. 07725994.3 with English translation (25 pages).

Jürgen Seidel, "CSP Plant Design and Roll Implications"; Vortrag and Veröffentlichung, Rolls 2003, 9-11, ICC, Birmingham, UK (2003).

Mit nachträglichen Eriauterungen versehene Figuren 7 and 9 (5 Seiten)(2003).

R. Lathe et al., "Optimisation of the rolling process (pass scheduling) to avoid roll spalling and surface defects", Final Report der European Commission, technical steel research, EUR 22054 (2006).

"Optimising of the rolling process (pass scheduling) to avoid roll spalling and surface defects", Corids Angaben zum Veröffentlichungdatum von 2.) (5 Seiten) (2001-2004).

F. Decultieux et al., "Backup Roll Chamfer Design, Profile and Maintenance", Teilablichtung aus der MS&T Conference Proceedings pp. 311-321(2004).

Bai Zhenhua et al., "Research of the Roll Crown Optimization on Skin Pass Mill in Baosteel 2050 Hot Rolling Plant", Iron and Steel, vol. 37, No. 9 (2002) pp. 35-38.

International Search Report dated Sep. 11, 2007, issued in corresponding international application No. PCT/EP2007/005218.

* cited by examiner

ROLLING MILL STAND FOR THE PRODUCTION OF ROLLED STRIP OR SHEET METAL

CROSS REFERENCE TO RELATED APPLICATION

The present application is a 35 U.S.C. §§371 national phase conversion of PCT/EP2007/005218, filed Jun. 13, 2007, which claims priority of Austrian Application No. A1021/2006, filed Jun. 14, 2006, incorporated by reference herein. The PCT International Application was published in the German language.

BACKGROUND OF THE INVENTION

The invention relates to a rolling mill stand for the production of rolled strip or sheet metal. It includes working rolls which are supported on supporting rolls or intermediate rolls. The supporting rolls, the working rolls and/or the intermediate rolls are arranged in the rolling mill stand so as to be displaced axially with respect to one another. Each working and/or intermediate roll has a curved barrel contour which runs over the entire effective barrel length and can be described by a trigonometric function. These two barrel contours complete one another in a complementary way, in the non-loaded state, solely in one specific relative axial position of the rolls of the pair of rolls.

In four-high rolling mill stands or six-high rolling mill stands, it is common practice to equip at least the two working rolls or the two intermediate rolls with a special barrel contour and to provide axially acting adjustment devices for these working rolls or supporting rolls, so that the roll nip contour can be set as a function of the current rolled strip profile.

A rolling mill stand of the generic type is already known from AT 410765 B. The roll barrel contour of these rolls known among specialists by the designation SmartCrown® can be described mathematically by a modified sine function. A suitable choice of the contour parameters results in this case in a cosinuoidal clear roll nip, the amplitude of which can be influenced in a directed way by the axial displacement of the rolls.

When working rolls or intermediate rolls with this special barrel contour and cylindrically shaped supporting rolls are used in four-high or six-high rolling mill stands, as is normally customary, it is unavoidable that load distributions which are inhomogeneous occur between the supporting rolls and the directly adjacent rolls during continuous rolling operation. Since the crowning region to be covered with the aid of the contoured rolls is always determined by the requirements of the rolling process, such as, for example, by different process parameters, dimensions and deformation properties of the rolling stock, the displacement stroke of the contoured rolls is the only influencing variable with which the markedness of the inhomogeneity of the load distribution can be influenced.

SUMMARY OF THE INVENTION

The object of the present invention, therefore, is to avoid the above-described disadvantages of the prior art and to propose a rolling mill stand, in which inhomgeneities in the load distribution along the contact line of the supporting rolls and their adjacent rolls is minimized and, in particular, local load peaks in the load distribution profile are reduced and, consequently, the duration of use of the rolls and the necessary regrinding intervals are increased.

In a rolling mill stand of the type initially described, this object is achieved in that the supporting rolls have a complementary barrel contour and a partial or full completion of the barrel contours of the supporting rolls and of the directly adjacent working rolls or intermediate rolls occurs in the non-loaded state.

In a four-high stand, this partial or full completion of the barrel contours relates to the two supporting rolls and the in each case adjacent working rolls. In a six-high stand, this partial or full completion of the barrel contours relates to the two supporting rolls and the in each case adjacent intermediate rolls.

From the point of view of process control, a short displacement stroke of the working rolls as possible is advantageous, since both the displacement time and the displacement guides to be provided in the plant can consequently be kept short. However, a short displacement stroke has the effect that, in the case of a predetermined set profile region of the working rolls, greater differences in diameter over the barrel length occur than with a longer displacement stroke. These disadvantages arising from a short displacement stroke can be reduced appreciably by the complementary completion of the barrel contours of the supporting rolls and of adjacent rolls.

According to one possible embodiment of the invention, the rolls in the rolling mill stand are oriented such that a full completion of the barrel contours of the supporting rolls and of the directly adjacent working rolls or intermediate rolls occurs in the nondisplaced state of the directly adjacent working rolls or intermediate rolls.

However, since the maximum displacement stroke, as a rule, is substantially shorter than the roll barrel length, even in a displaced state of the rolls, substantially smaller nips occur between the rolls in the non-loaded state than in the case of cylindrical supporting rolls, and therefore an approximately homogeneous load distribution between the rolls is obtained in each operating state.

According to a further possible embodiment of the invention, the basic object is also achieved when an incomplete completion of the barrel contours of the supporting rolls and of the directly adjacent working rolls or intermediate rolls occurs in the nondisplaced state of the directly adjacent working rolls or intermediate rolls, on the condition that, in the case of a supporting roll radius $R_B(x)$ according to the formula $$R_B(x)=R_0+k\cdot r_B(x), \text{ where}$$

$R_B(x)$ is the supporting roll radius at the point x of the axial supporting roll extent, $R_0$ is the radius offset, $r_B(x)$ is the contour at the point x of the axial supporting roll extent, and k is a correcting factor, the correcting factor k is being fixed in the interval $0<k\leqq 2$, excluding the value k=1.

This formalism can be illustrated on the basis of a consideration of the geometric relations in a full completion of the roll barrel contours of a supporting roll and of its adjacent roll.

In a full completion of the roll barrel contour of the supporting roll and of the adjacent roll (intermediate roll or working roll), the axes of the two rolls are parallel in the non-loaded state. For the radii of the rolls, this means:

$$R_N(x)+R_B(x)=A$$

where $R_N(x)$ is the radius of the adjacent roll at the point x, $R_B(x)$ is the radius of the supporting roll at the point x, and A is the distance between axes.

The contour of the supporting roll is also in this case determined completely by the definition of the contour of the working roll or intermediate roll. The radius is in this case composed of an offset value $R_0$ and of the actual contour $r_B$ which represents a modified sine function:

$$R_B(x)=A-R_N(x)=R_0+r_B(x)$$

where $R_0$ is the radius offset, and $r_B(x)$ is the contour at the point x.

An incomplete completion therefore occurs when the contour function $r_B$ is modified by a correcting factor k. There follows from this:

$$R_B(x)=R_0+k\cdot r_B(x)$$

where k is the contour factor ($k\neq 1$).

In the event that k=1, the full completion of the roll barrel contours is obtained. In the case of a deviation of the contour factor k from the value k=1, a full completion of the roll barrel contours is no longer afforded. The contour factor may be greater than or less than 1. The position of the extreme points and of the inflection points of the roll barrel contour in this case remains unchanged. If the contour factor k assumes the value 0, the supporting roll barrel contour becomes cylindrical. A sufficient minimization of the inhomogeneities in the load distribution along the roll barrel contour is achieved by means of correcting factors in the selected range $0<k\leqq 2$, excluding the value k=1.

In order to avoid inadmissibly high edge pressings between the working rolls and supporting rolls or between the intermediate rolls and supporting rolls, barrel ends of the rolls are usually chamfered and therefore have a clearance in these marginal regions. Clearances of this type are already known from EP 0 258 482 A1 or EP 1 228 818 A2. These clearances, in the case of contoured roll barrels, are formed in marginal regions with a barrel radius increasing toward the margin, by a cylindrical barrel end, as is illustrated in EP 0 258 482 A1, or, in the case of rolls with a cylindrical roll barrel contour, may be formed by a conical marginal region, as illustrated and described, for example, in EP 1 228 818 A2. In any event, where these known clearances are concerned, there is only a shift of the critical pressing from the barrel ends (edges) to the transition region between the remaining barrel contour and the contour of the chamfer, since, in this configuration of the chamfer, once again, a kink in the contour profile of the roll barrel occurs.

In order further to equalize the load at the end regions of the roll barrels and consequently reduce peak loads caused by pressing, the barrel contour of the working rolls or of the intermediate rolls or of the supporting rolls has, in at least one of the marginal regions of their longitudinal extent, chamfers which in these marginal regions form corrected barrel contours which are obtained by subtracting any mathematical chamfer function from the contour function, the pitch of the barrel contour and the pitch of the corrected barrel contour at the transition point from the barrel contour to the corrected barrel contour being identical.

Very good results with regard to minimizing and equalizing the load distribution are achieved when the chamfer function is formed by a trigonometric function. Similarly good results are also achieved when the chamfer function is formed by a sine function or a second order function, for example a parabolic function.

Further advantages and features of the present invention may be gathered from the following description of unrestrictive exemplary embodiments, reference being made to the accompanying Figures:

DESCRIPTION OF PREFERRED EMBODIMENTS

In FIGS. 1 to 4, the load distribution between the supporting rolls and working rolls in the case of a roll barrel contour according to the prior art is compared with the load distribution between supporting rolls and working rolls in a roll barrel contour according to the invention using the example of a four-high stand.

THE PRIOR ART

Figure 1:
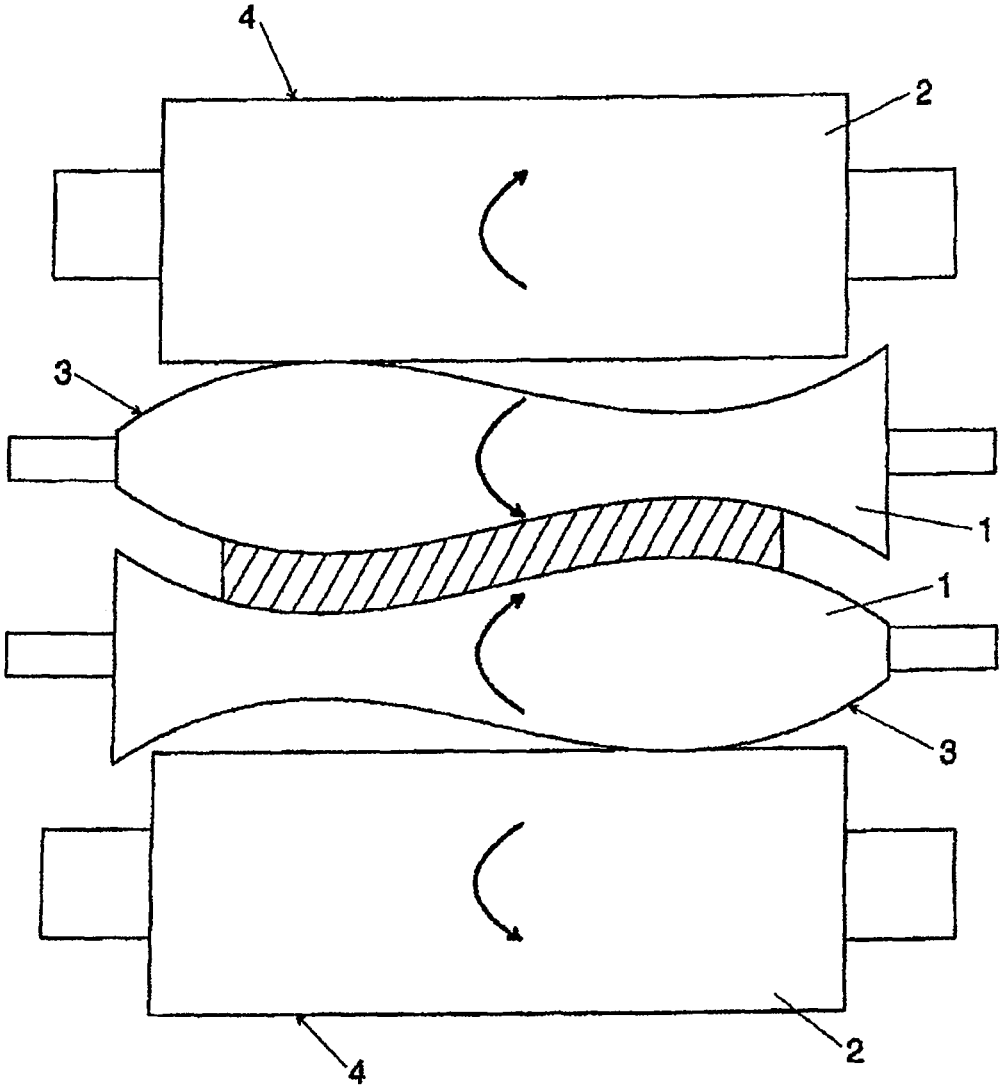
Fig. 1 PRIOR ART
FIG. 1 shows a diagrammatic illustration of a four-high roll stand with contoured working rolls and cylindrical supporting rolls according to the prior art.
Figure 2:
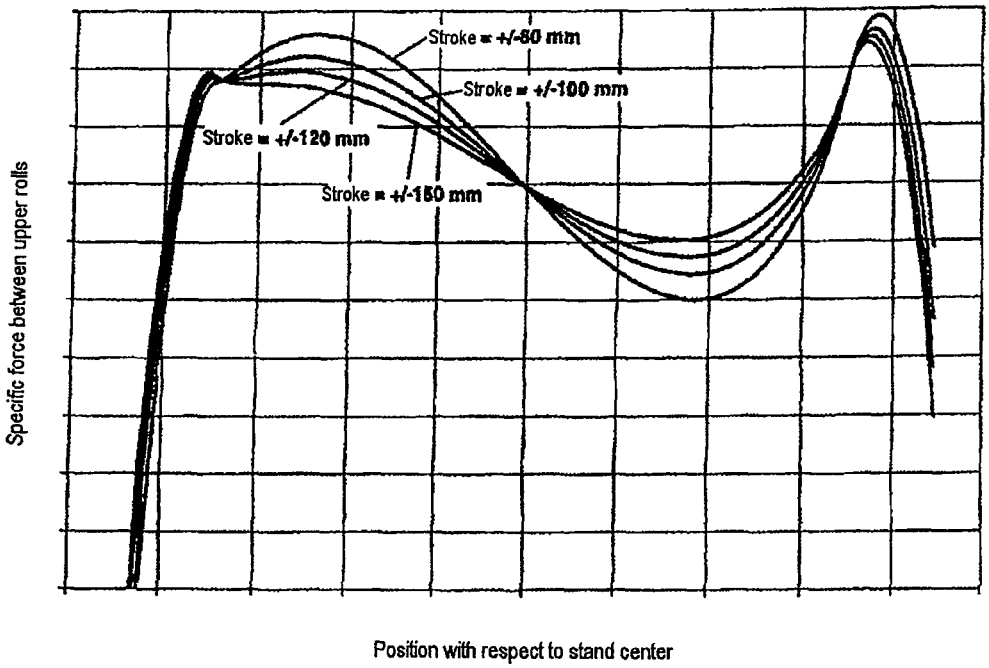
Fig. 2 PRIOR ART
FIG. 2 shows the typical load distribution between the working rolls and supporting rolls in a four-high stand according to FIG. 1.

FIG. 1 shows a diagrammatic illustration of the roll arrangement in a four-high stand for rolling a metal strip B, in particular a steel strip, with working rolls 1 and supporting rolls 2. The axially displaceable working rolls 1 have in each case a barrel contour 3 which can be described by a modified sine function. These barrel contours 3 complete one another in a complementary way in one specific relative axial position of the rolls of the pair of working rolls. The working rolls 1 are supported by supporting rolls 2 which have a cylindrical barrel contour 4 and which support rolling forces acting on the working rolls. The load distribution between the upper working roll 1 and the upper supporting roll 2 is illustrated in FIG. 2 for this case of roll barrel configuration. The specific force between the rolls plotted against the barrel length. On the one hand, load peaks occur at the edge region and, on the other hand, maximum and minimum values occur according to the sinusoidal contour profile. Load distribution curves are illustrated for four selected values of the maximum relative axial displacement (displacement stroke) of the working rolls with respect to one another.

Figure 3:
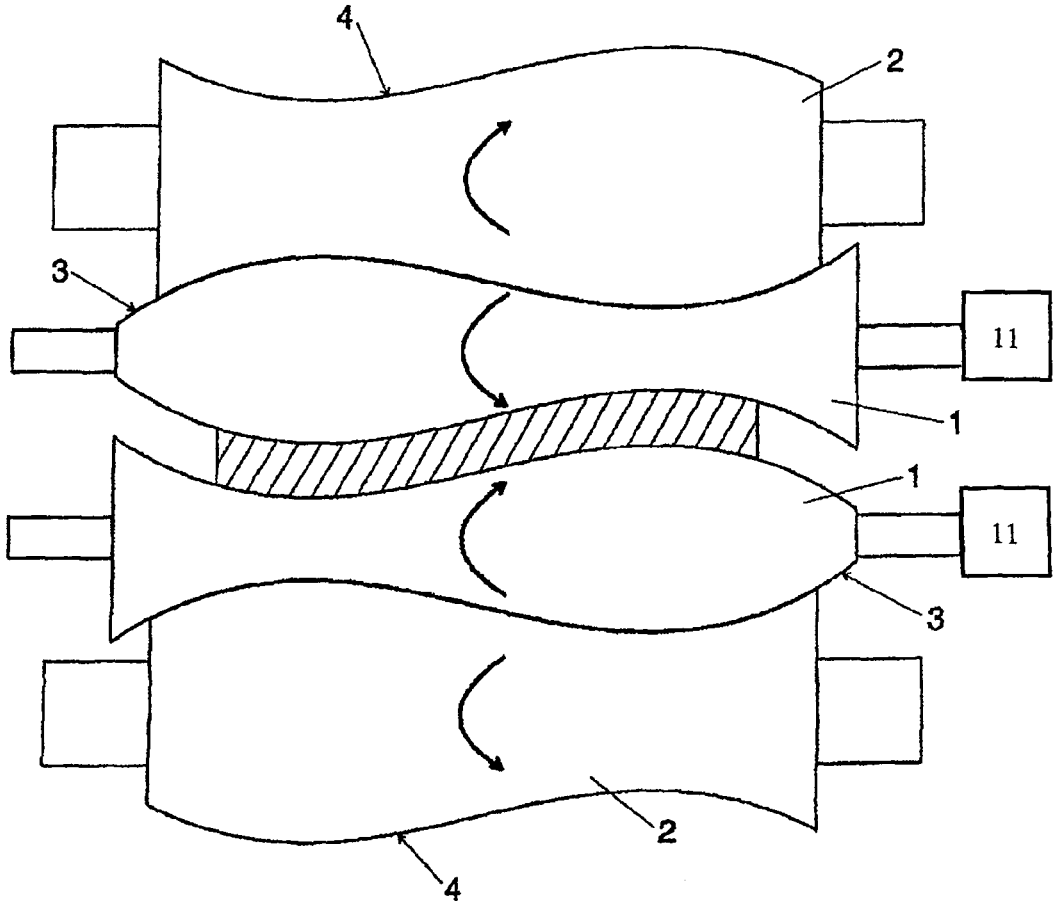
FIG. 3 shows a diagrammatic illustration of a four-high stand with contoured working rolls and complementary supporting rolls according to the invention.
Figure 4:
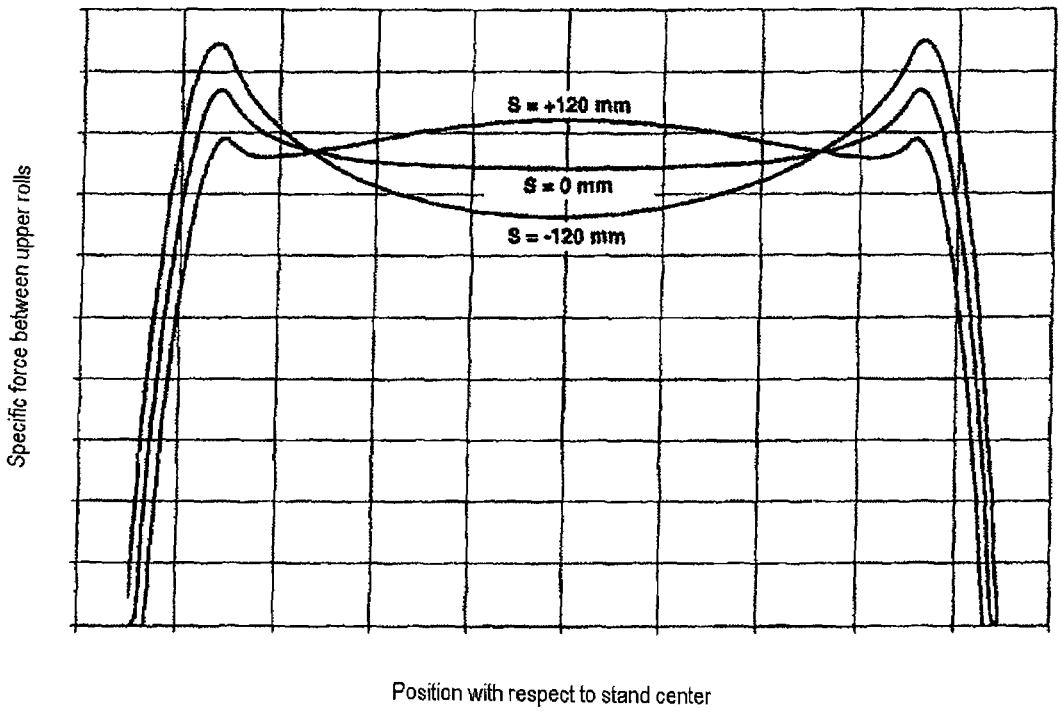
FIG. 4 shows the typical load distribution between the working rolls and supporting rolls in a four-high stand with the roll designed according to the invention, as shown in FIG. 3.

FIG. 3 shows a diagrammatic illustration of the roll arrangement in a four-high stand with working rolls 1 and supporting rolls 2. The working rolls 1 are axially displaceable by known displacement devices 11 acting on an end of each working roll 1. The axially displaceable working rolls 1 have in each case a barrel contour 3 which can be described by a modified sine function. These barrel contours complete one another in a complementary way in one specific relative axial position of the working rolls. The two supporting rolls 2 likewise have a mutually completing complementary barrel contour 4 which is likewise formed by a modified sine function. The barrel contours of the adjacent interacting working roll 1 and supporting roll 2 complete one another fully in a non-loaded state. The load distribution between the upper working roll 1 and the upper supporting roll 2 is illustrated in FIG. 4 for this case of the roll barrel configuration. Load peaks in the edge region occur to a differing extent as a function of the axial displacement. Overall, however, in this version according to the invention, a basic equalization of the load distribution over the roll barrel profile is already exhibited.

Figure 5:
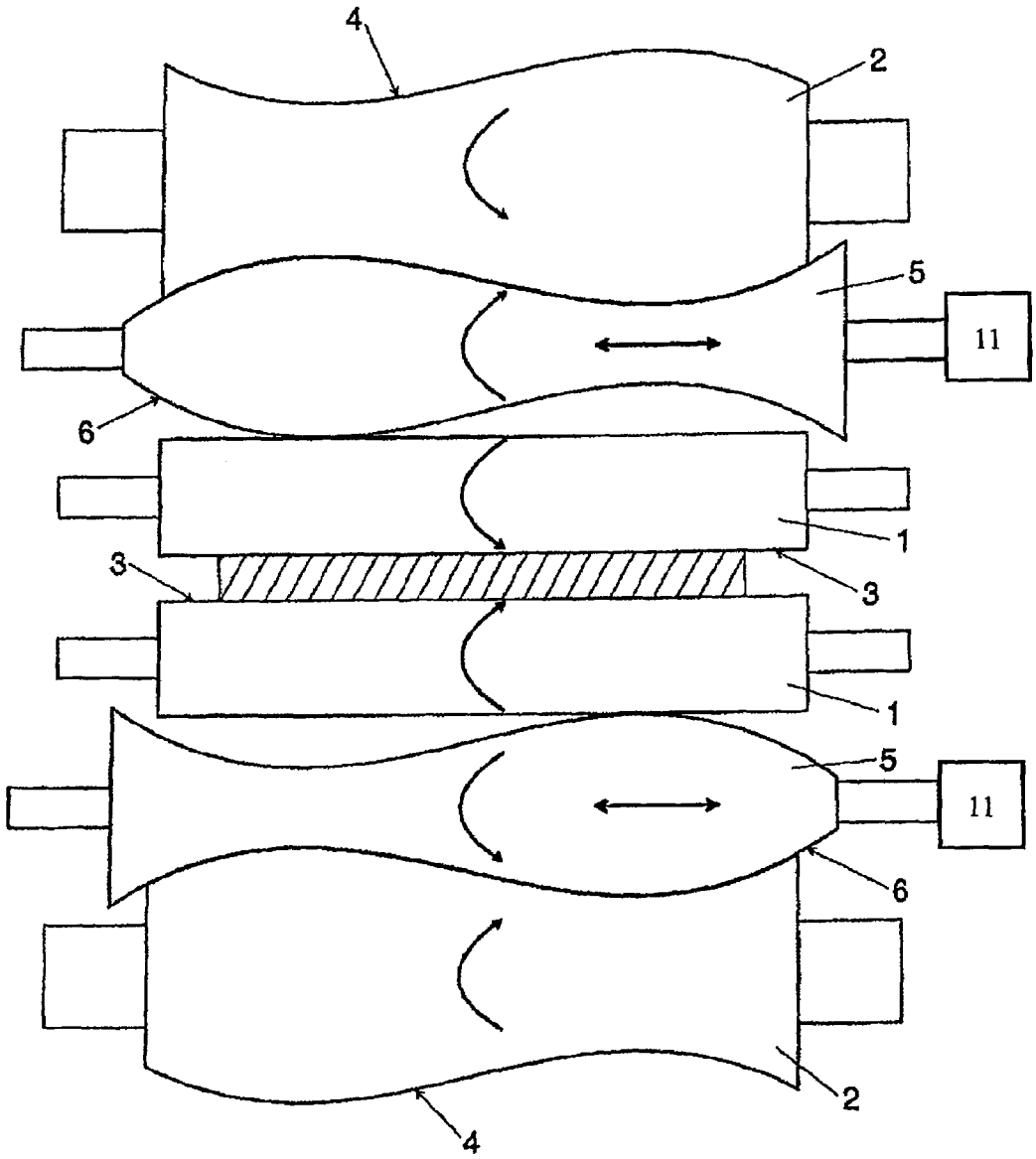
FIG. 5 shows a diagrammatic illustration of a six-high stand with contoured supporting rolls and complementary intermediate rolls according to the invention.

FIG. 5 shows a diagrammatic arrangement of the roll arrangement in a six-high stand with working rolls 1 midway in the height of the stand, intermediate rolls 5 outward of the working rolls and supporting rolls 2 outward of the intermediate rolls. The working rolls are supported via the intermediate rolls on the supporting rolls. The working rolls 1 are equipped with a cylindrical barrel contour 3. According to a further possible configuration, however, the barrel contour of the working rolls may also be oriented with respect to the barrel contour of the adjacent intermediate rolls. The intermediate rolls 5 have a barrel contour 6 which can be described by a modified sine function. The supporting rolls 2 likewise have a barrel contour 4 which can be described by a sine function. The barrel contours 4 of the supporting rolls 2 and the barrel contour of the intermediate rolls 5 complete one another fully in the non-loaded state in the nondisplaced axial position of the axially adjustable intermediate rolls 5. In this case, there are known means 11 which can adjust the intermediate rolls axially, relative to the other rolls.

Figure 6:
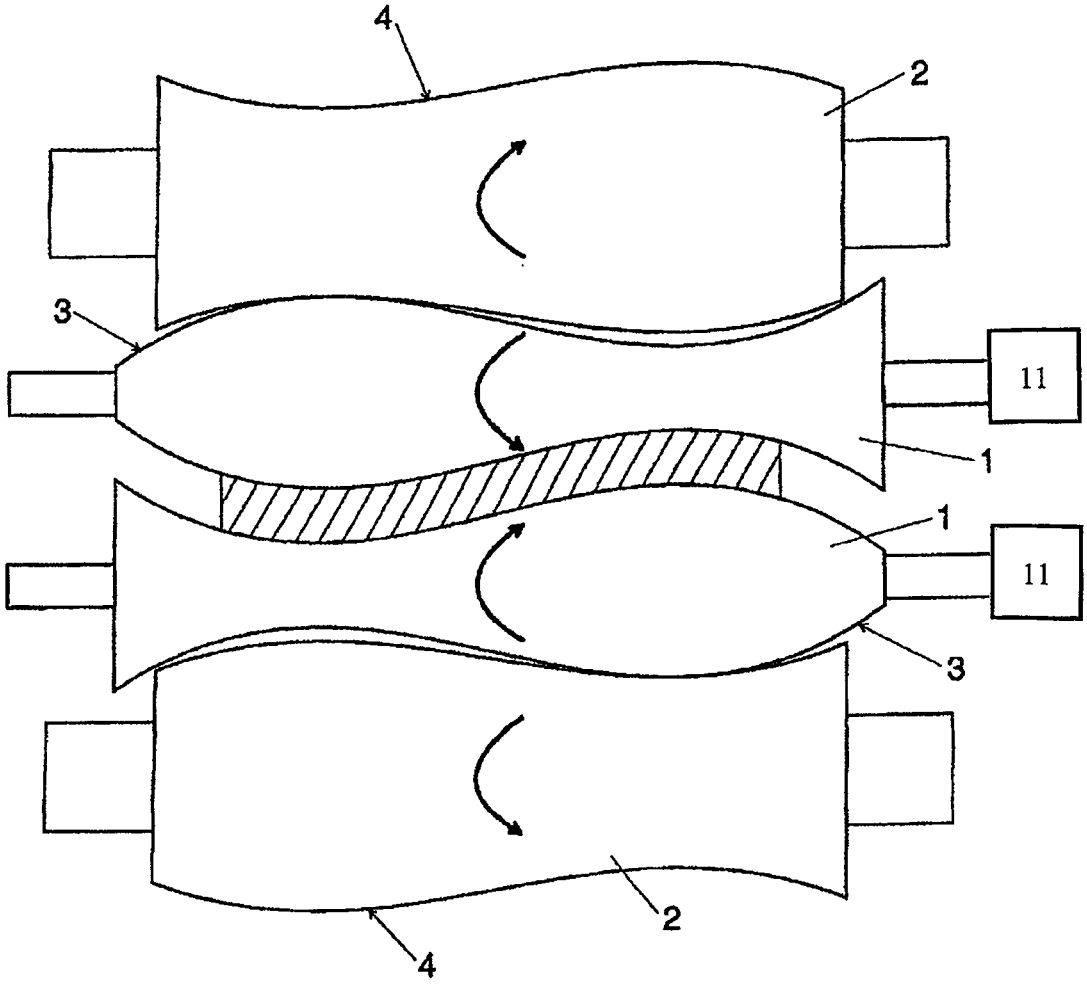
FIG. 6 shows a diagrammatic illustration of a four-high stand with contoured working rolls and complementary supporting rolls according to the invention, with a correcting factor k=0.75.

FIG. 6 shows a diagrammatic illustration of working rolls 1 and supporting rolls 2 in a four-high stand, the basic set-up of the barrel contours 3, 4 following the embodiment according to FIG. 3. However, the contour profile is varied by means of a contour factor k=0.75, with the result that there is in this case only a partial completion of the barrel contours of the supporting roll 2 and of the directly adjacent working roll 1 in the non-loaded state.

According to an embodiment which is not illustrated, it is likewise possible in a six-high stand, in a similar way to FIG. 5, to vary the contour profile of the supporting rolls and the intermediate rolls by means of a correcting factor k, with the result that there is in this case only a partial completion of the barrel contours of the supporting roll and of the directly adjacent intermediate roll in the non-loaded state.

Figure 7:
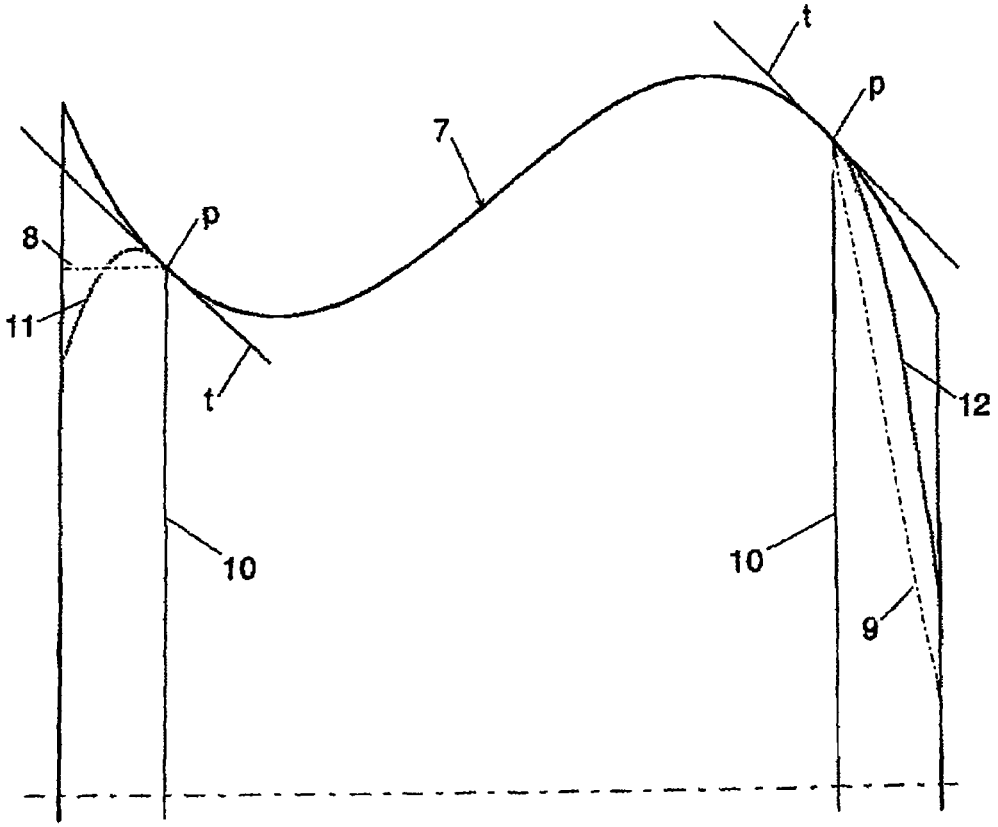
FIG. 7 shows the contour according to the invention of the upper supporting roll with a circular chamfer in comparison with a barrel contour according to the prior art.

FIG. 7 illustrates the profile of the roll barrel contour 7 of a supporting roll or intermediate roll or working roll over the barrel length. Dashed and dotted lines 8, 9 illustrate possibilities, known from the prior art, for chamfering a roll in its end regions in order to avoid high edge pressings. The chamfer according to the dashed and dotted line 8 generates a cylindrical end region, and the chamfer according to the dashed and dotted line 9 generates a conical end region on the rolls. In both cases a kink 10 occurs in the contour profile over the barrel length, which kink forms a continuous edge on the roll. An improvement in the load conditions arises due to a chamfer which gradually approaches the barrel contour, thus giving rise on both sides to a corrected barrel contour which is illustrated by the dotted lines 11 and 12. At the transition point P of the barrel contour into the corrected barrel contour, both curved profiles are the same pitch as the tangent t.

The invention claimed is:

1. A rolling mill stand for the production of rolled strip or sheet metal, comprising:

a pair of working rolls positioned and extending in directions so as to form a roll nip; a respective intermediate roll outward of each working roll and operable to support the respective one of the working rolls during rolling; a respective supporting roll outward of each intermediate roll and supporting the respective one of the intermediate rolls during rolling;

the intermediate rolls arranged in the rolling mill stand so as to be displaceable axially with respect to one another, a device for axially displacing the intermediate rolls, each intermediate roll having a first curved barrel contour which runs over an entire effective barrel length of the intermediate roll, the first barrel contour being described by a first trigonometric function, each supporting roll having a second complementary barrel contour described by a second trigonometric function, the first barrel contours of the intermediate rolls being shaped for completing the second barrel contours of the respective supporting rolls in a complementary way, such that in a non-loaded state, solely in one specific relative axial position of the rolls of the pair of intermediate rolls, a partial or full completion of the second barrel contour of each supporting roll and the first barrel contour of a respective directly adjacent intermediate roll occurs in the non-loaded state, the first barrel contours and the second barrel contours having no kinks therein, no continuous edges generated by such kinks being formed on any of the intermediate rolls or the supporting rolls.

2. The rolling mill stand as claimed in claim 1, wherein the intermediate and the supporting rolls are contoured such that a full completion of the barrel contours of the supporting rolls and of the directly adjacent intermediate rolls occurs in an axially nondisplaced state of the directly adjacent intermediate rolls.

3. The rolling mill stand as claimed in claim 1, wherein the intermediate rolls and the supporting rolls are contoured such that an incomplete completion of the barrel contours of the supporting rolls and of the directly adjacent intermediate rolls occurs in an axially nondisplaced state of the directly respectively adjacent intermediate rolls in the condition that the supporting roll has a radius $R_B(x)$ according to the formula $$R_B(x)=R_0+k\cdot r_B(x), \text{ where}$$

$R_B(x)$ is the supporting roll radius at the point x of the axial supporting roll extent, $R_0$ is the radius offset, $r_B(x)$ is the contour at the point x of the axial supporting roll extent, k is a correcting factor, wherein the correcting factor k is fixed in the interval $0<k=2$, excluding the value k=1.

4. The rolling mill stand as claimed in claim 3, wherein the intermediate rolls and the supporting rolls have marginal regions toward ends of the rolls, the barrel contours of the intermediate rolls or the supporting rolls include chamfers in at least one of the marginal regions of the longitudinal extent of the intermediate rolls and the supporting rolls, wherein in these marginal regions, corrected barrel contours are formed which are obtained by subtracting any mathematical chamfer function from the first trigonometric function or from the second trigonometric function, and a pitch of the barrel contour and a pitch of the corrected barrel contour at the transition point from the barrel contour to the corrected barrel contour is identical.

5. The rolling mill stand as claimed in claim 4, wherein the chamfer function is a trigonometric function.

6. The rolling mill stand as claimed in claim 4, wherein the chamfer function is a sine function.

7. The rolling mill stand as claimed in claim 4, wherein the chamfer function is a second order function.

8. The rolling mill stand as claimed in claim 1, wherein the intermediate rolls and the supporting rolls have marginal regions toward ends of the rolls, the barrel contours of the intermediate rolls or the supporting rolls includes chamfers in at least one of the marginal regions of the longitudinal extent of the intermediate rolls and the supporting rolls, wherein in these marginal regions, corrected barrel contours are formed which are obtained by subtracting any mathematical chamfer function from the first trigonometric function or from the second trigonometric function, and a pitch of the barrel contour and a pitch of the corrected barrel contour at the transition point from the barrel contour to the corrected barrel contour is identical.

* * * * *

UNITED STATES PATENT AND TRADEMARK OFFICE

CERTIFICATE OF CORRECTION

PATENT NO. : 8,413,476 B2
APPLICATION NO. : 12/304937
DATED : April 9, 2013
INVENTOR(S) : Seilinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1150 days.

Signed and Sealed this
First Day of September, 2015

Michelle K. Lee

Michelle K. Lee
*Director of the United States Patent and Trademark Office*